US007234327B2

(12) United States Patent
Howes

(10) Patent No.: US 7,234,327 B2
(45) Date of Patent: Jun. 26, 2007

(54) ADJUSTABLE LOCKING MECHANISM FOR CONTAINER

(75) Inventor: Donald E. Howes, Victoria (CA)

(73) Assignee: Wasteline Rentals Ltd., Victoria (GB)

( * ) Notice: Subject to any disclaimer, the term of this patent is extended or adjusted under 35 U.S.C. 154(b) by 216 days.

(21) Appl. No.: 10/993,201

(22) Filed: Nov. 19, 2004

(65) Prior Publication Data

US 2005/0138976 A1 Jun. 30, 2005

Related U.S. Application Data

(63) Continuation-in-part of application No. 10/449,985, filed on May 30, 2003, now Pat. No. 6,851,288.

(30) Foreign Application Priority Data

Apr. 2, 2004 (CA) ..... 2463207

(51) Int. Cl.
*B65D 55/14* (2006.01)

(52) U.S. Cl. ..... 70/159; 70/164; 70/58; 292/230; 220/315; 220/908

(58) Field of Classification Search ..... 70/14, 70/18, 19, 57, 58, 63, 159–169; 248/551–553; 220/908, 315; 292/228, 230
See application file for complete search history.

(56) References Cited

U.S. PATENT DOCUMENTS 4,182,530 A 1/1980 Hodge
4,290,281 A 9/1981 Knaack et al.
4,585,138 A 4/1986 Jonkers
4,609,125 A 9/1986 Willingham
4,625,891 A 12/1986 Lilly
4,873,848 A 10/1989 Honeyman
4,955,501 A 9/1990 Hodge
5,042,856 A 8/1991 Goodman
5,052,199 A 10/1991 Derman
5,076,078 A 12/1991 Weger, Jr.
5,085,340 A 2/1992 Doxey et al.
5,090,753 A * 2/1992 Goodman ..... 292/230
5,094,358 A 3/1992 Serio, Sr.
5,103,994 A 4/1992 Doxey et al.
5,118,000 A 6/1992 Howell et al.
5,149,153 A * 9/1992 Drewry et al. ..... 292/104
5,213,382 A 5/1993 Dawdy et al.
5,224,743 A 7/1993 Dawdy et al.
5,415,314 A 5/1995 McCollum
5,419,598 A 5/1995 Kreitzer (Continued)

*Primary Examiner*—Suzanne Dino Barrett
(74) *Attorney, Agent, or Firm*—Ryan A. Schneider, Esq.; Troutman Sanders LLP

(57) ABSTRACT

A lockable container comprising an open-faced receptacle with a locking mechanism aperture, at least one lid covering at least a portion of the open face of the receptacle, and a locking mechanism for engaging with a padlock and securing the lid in a partially opened position over the receptacle open face. The locking mechanism has a receptacle engagement portion that is moveable into a receptacle engagement position, and when in such position, a lid engagement portion attached to the receptacle engagement portion receives the partially opened lid, and a lock engagement portion attached to the lid engagement portion is moveable into the receptacle and through the locking mechanism aperture, and out of the receptacle, where it is engageable with a padlock.

19 Claims, 9 Drawing Sheets

U.S. PATENT DOCUMENTS 5,474,341 A 12/1995 Putman
5,595,073 A 1/1997 Sullivan
5,599,050 A * 2/1997 Tinsley ..... 292/230
5,662,364 A * 9/1997 Reeb et al. ..... 292/230
5,683,126 A 11/1997 De Vivo et al.
5,740,584 A 4/1998 Hodge et al.
5,997,052 A * 12/1999 Reeb et al. ..... 292/148
6,276,562 B1 8/2001 Hodge et al.
6,279,822 B1 8/2001 Bertram
6,298,695 B1 10/2001 Vezina et al.
6,427,499 B1 8/2002 Derman
6,733,053 B2 5/2004 Hodge et al.
6,772,613 B2 8/2004 Derman
6,851,288 B2 * 2/2005 Howes ..... 70/159

* cited by examiner

ADJUSTABLE LOCKING MECHANISM FOR CONTAINER

BENEFIT CLAIM

This application is a continuation-in-part of application Ser. No. 10/449,985, filed 30 May 2003 now U.S. Pat. No. 6,851,288.

FIELD OF THE INVENTION

This invention relates generally to locking mechanisms and lockable containers having such mechanisms.

BACKGROUND OF THE INVENTION

Externally-stored waste containers such as front-load and roll-off waste containers are prone to being raided by trash pickers or "dumpster divers" seeking to find valuable items among the refuse. It is desirable to discourage this activity, as it tends to create a mess around the containers, may damage the containers, and compromises the security and confidentiality of the materials being discarded. Some jurisdictions have proposed or enacted ordinances to make such activity illegal.

Many waste containers are locked to discourage dumpster diving. Typically, a metal chain is wrapped around the container and its lid and secured in place with a padlock. However, handling the chain tends to be cumbersome and the padlock and chain are exposed and thus vulnerable to tampering. There have been proposals to locate a padlock within a container such that the padlock is not exposed to tampering. For example, U.S. Pat. No. 4,290,281 (Knaack et al.) discloses a lock system for a container, such as a tool box or a storage cabinet, which is locked by a padlock. A structure within the container mounts the padlock within the container with only a key insertion end of the padlock body exposed for access thereto. However, the specific structure as disclosed is relatively complex, making construction of containers having such structure relatively expensive. Furthermore, such structure is integrated into the container in such a way that makes it difficult to retrofit to existing containers.

U.S. Pat. No. 5,076,078 (Weger Jr.) discloses a padlock protecting system for use with a container having a movable closure. A shelf supports the padlock within the container such that only the key insertion end of the padlock is exposed for external access and a bracket having one or more depending legs is carried by the supporting shelf and captures the shackle of the padlock. A tang is associated with the movable closure and is positionable within the shackle to capture the padlock thereby maintaining the closure in a closed position. Like the '281 patent, the padlock protecting system disclosed in Weger is relatively complex, and is integrated into the container in such a way that makes it difficult to retrofit to existing containers.

It is therefore desirable to provide a locking mechanism for a container, that is relatively simple, effective to keep the container lid in a closed position, and is resistant to tampering. It is further desirable to provide a locking mechanism that can be retrofitted to an existing container. It is further desirable for such locking mechanism to be adjustable to allow limited access into the container, e.g. to deposit cardboard for recycling.

SUMMARY OF THE INVENTION

According to one aspect of the invention, there is provided a lockable container comprising an open-faced receptacle, at least one lid movably attached to the receptacle and covering at least a portion of the open face of the receptacle, and a locking mechanism for engaging with a padlock and securing the lid over the receptacle open face. The receptacle comprises a base, a top with a main receptacle opening, and a side wall extending around and between the base and top. The receptacle can have a locking mechanism aperture in the side wall. The locking mechanism comprises a receptacle engagement portion, and first and second lid engagement portions. The receptacle engagement portion is movably attached to the receptacle and movable into a lid engagement position. The first lid engagement portion is attached to the receptacle engagement portion such that the lid engagement portion extends sufficiently over the lid to impede the lid from opening when the lid is in the closed position and the receptacle engagement portion is in the lid engagement position. The second lid engagement portion is attached to the receptacle engagement portion such that the lid is securable in a partially opened position when the receptacle engagement portion is in the lid engagement position.

The locking mechanism is lockable by a padlock such that the receptacle engagement portion is fixed in the lid engagement position. In particular, the locking mechanism can have a lock engagement portion that is attached to the lid engagement portion and that is extendable through the receptacle opening into the receptacle, and through the locking mechanism aperture out of the receptacle, and is securable in place with a padlock, when the lid engagement portion is in the lid engagement position, thereby securing the lid in the partially opened position. This position is particularly useful for allowing limited access into the receptacle, e.g. to deposit recyclable cardboard, but to prevent a person from entering into the receptacle to "dumpster dive".

The receptacle engagement portion can be a pivot arm having a proximal end that is pivotably attached to the receptacle side wall and a distal end that extends above the lid when the pivot arm is pivoted into the lid engagement position. The first lid engagement portion can be a first elongated member attached to the pivot arm such that the member extends sufficiently over the closed lid to impede the lid from opening when the pivot arm is in its lid engagement position. The second lid engagement portion can be a second elongated member attached to the pivot arm substantially parallel to and spaced from the first elongated member such that a slot is defined therebetween suitable to receive the lid edgewise.

The lock engagement portion can be a lock arm having a proximal end pivotably attached to the first or second elongated member and a distal end with an aperture for receiving the padlock. When the pivot arm is in the lid engagement position, the lock arm is pivotable into a lid securing position with the distal end extending through the receptacle opening into the receptacle, then through the locking mechanism aperture out of the receptacle, and securable in place with the padlock.

Instead of a single lid, the container can have a pair of lids mountable side-by-side over the receptacle opening such that sufficient space is provided therebetween to enable the lock arm to pivot into the receptacle. The lids are mounted on the receptacle such that the first and second elongated members extend over both lids.

The side wall can include a recess for receiving the padlock, and in such case, the lock mechanism aperture is located in a back wall of the recess. The recess dimensions can be selected to snugly receive the padlock in the recess thereby impeding access of padlock tampering devices to the padlock.

According to another aspect of the invention, there is provided a locking mechanism for a container having a receptacle with a base, a top with a main receptacle opening, and a side wall extending around and between the base and top and having a locking mechanism aperture, and a lid movably mounted to the receptacle and configured to cover a portion of the main receptacle opening. This locking mechanism can be provided in kit form that comprises a receptacle engagement portion, and first and second lid engagement portions. The receptacle engagement portion is movably attachable to the receptacle and movable into a lid engagement position. The first lid engagement portion is attachable to the receptacle engagement portion such that the lid engagement portion extends sufficiently over the lid to impede the lid from opening when the lid is in the closed position and the receptacle engagement portion is in the lid engagement position. The second lid engagement portion is attachable to the receptacle engagement portion such that the lid is securable in a partially opened position when the receptacle engagement portion is in the lid engagement position.

The locking mechanism can also have a lock engagement portion that is attachable to the lid engagement portion and is extendable through the receptacle opening into the receptacle, and through an aperture in the side wall of the receptacle, and is securable in place with a padlock, when the lid engagement portion is in the lid engagement position, thereby securing the lid in the partially opened position.

The locking mechanism can also include a receiving cup having a locking mechanism aperture and that is attachable to an aperture in the side wall of the receptacle. The receiving cup serves as a recess for receiving the padlock, and has an aperture for receiving the lock arm. The receiving cup dimensions can be selected to snugly receive the padlock in the receiving cup thereby impeding access of padlock tampering devices to the padlock.

DETAILED DESCRIPTION OF EMBODIMENTS OF THE INVENTION

Figure 1:
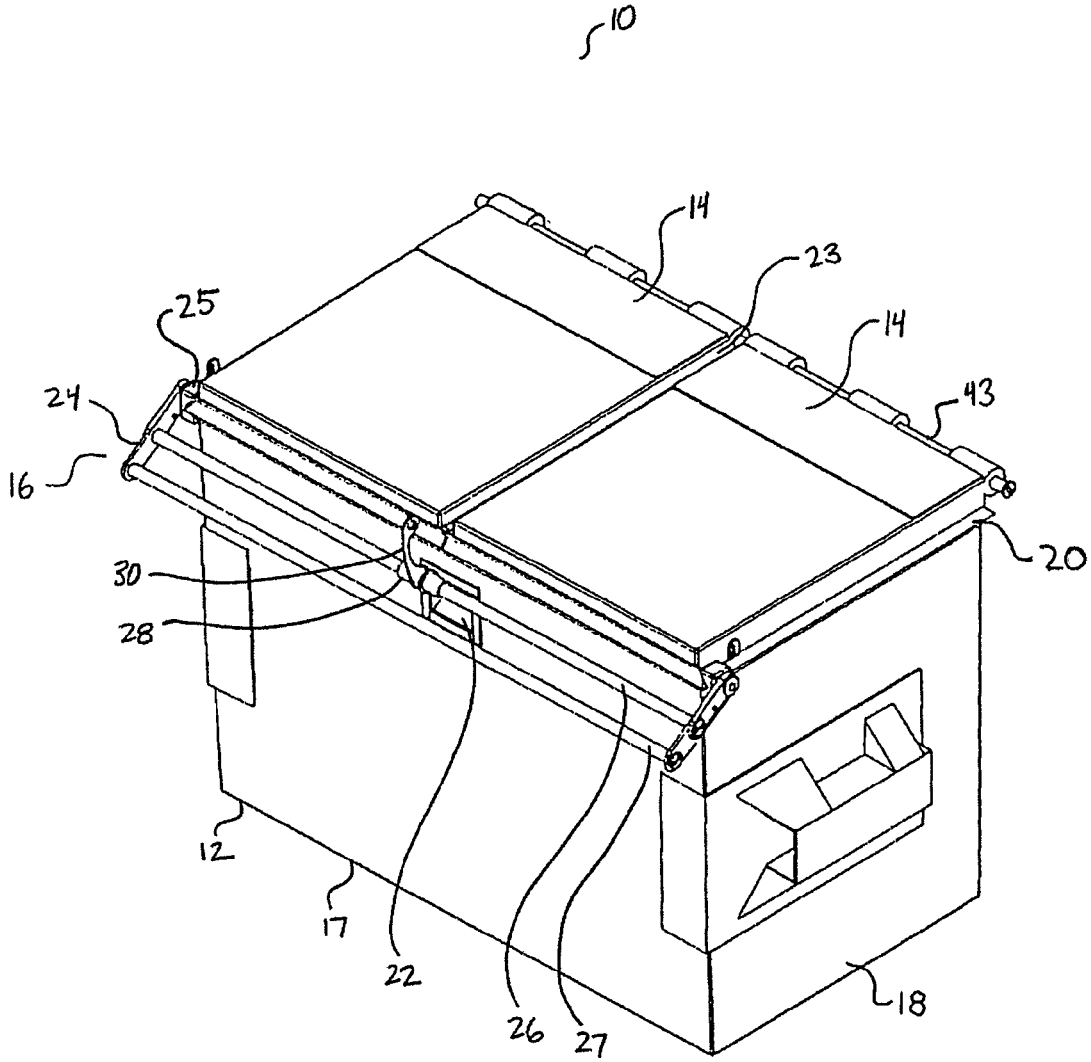
FIG. 1 is a schematic perspective view of an embodiment of a lockable waste container, having a locking mechanism in an unengaged position, and lids in a closed position.
Figure 2:
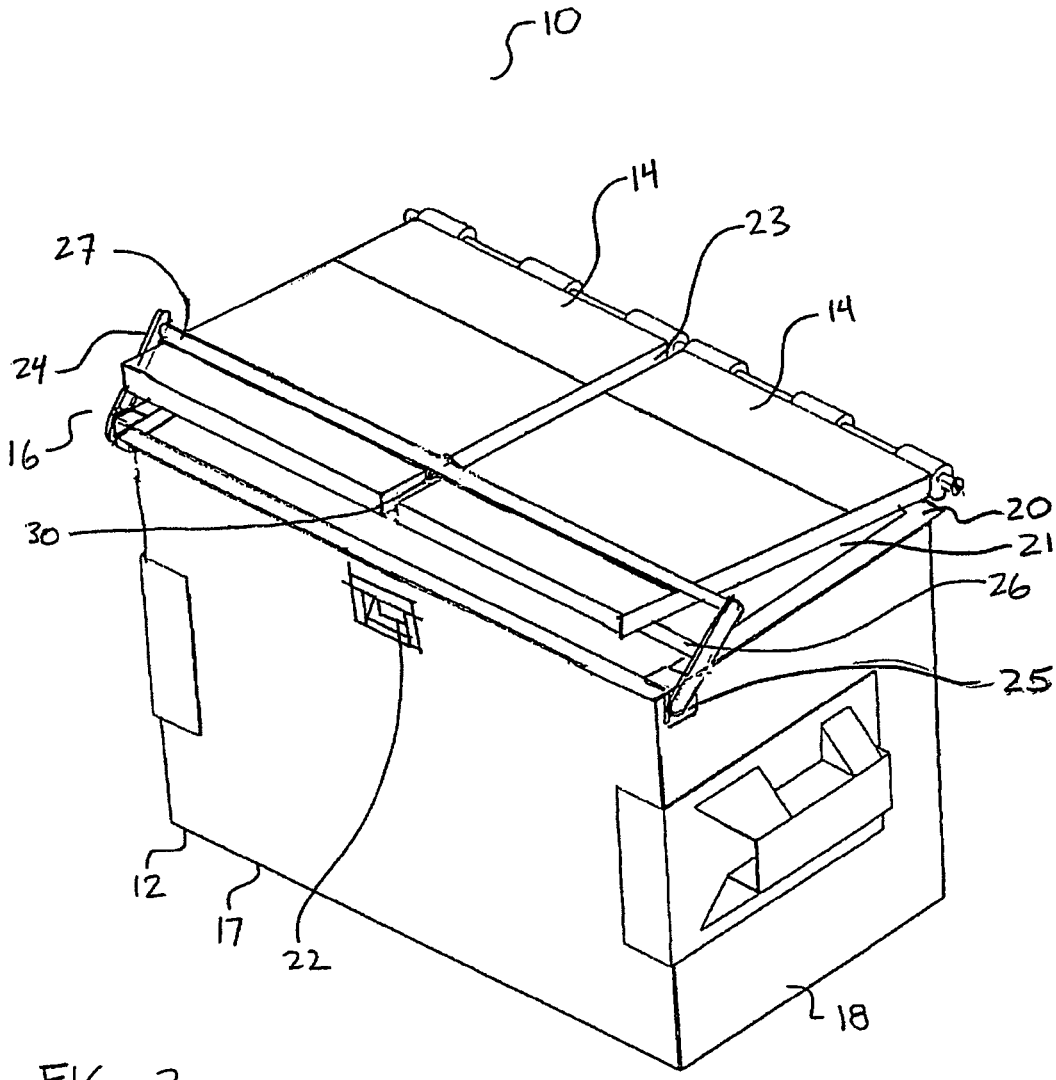
FIG. 2 is a schematic perspective view of the waste container wherein its locking mechanism is in an engaged position, and the lids fixed in a partially opened position.
Figure 3:
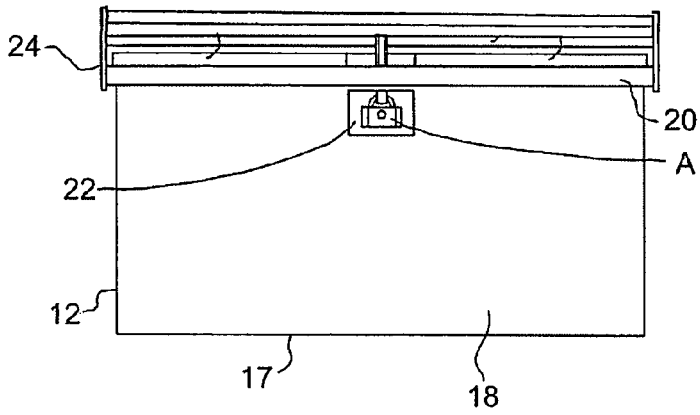
FIG. 3 is a schematic front elevation view of the waste container with its locking mechanism in the engaged position and the lids are fixed in the closed position.
Figure 4:
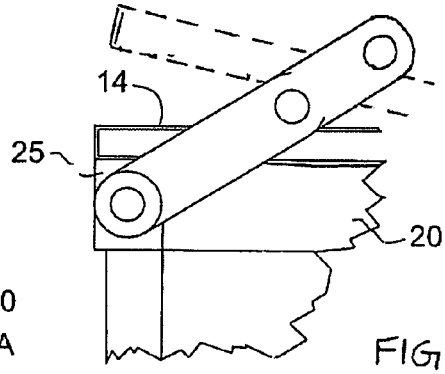
FIG. 4 is a schematic side elevation view of a portion of the waste container with its locking mechanism in the engaged position and the lids shown in solid line in the closed position, and shown in outline in the partially opened position.

Directional terms such as "top", "bottom", and "upwards" are used in the following description for the purpose of providing relative reference only, and are not intended to suggest any limitations on how any apparatus is to be positioned during use, or to be mounted in an assembly.

Referring to FIGS. 1–4 and according to a first embodiment of the invention, a lockable waste container 10 comprising a receptacle 12 and a pair of lids 14 is also provided with a locking mechanism 16 that when locked, secures the lids 14 in one of two positions, namely (1) a closed position over the receptacle 12 to prevent unauthorized access into the container 10, and (2) a partially opened position that is particularly useful for allowing limited access into the container 10, e.g. for depositing flat cardboard for recycling purposes.

The container receptacle 12 includes a rectangular base 17, four side walls 18 extending around and upwards from the base 17 to form an open-faced box. A lip 20 extends around the periphery of the upper edge of the side walls 18. The open face of the receptacle 12 serves as a main receptacle opening 21 for receiving waste. A receiving cup 22 is recessed into the front sidewall 18, and has a depth sufficient to receive a conventional padlock A (shown in FIG. 3). It is within the scope of the invention for the receptacle to have other shapes, e.g. cylindrical.

The pair of lids 14 are pivotably mounted to the back lip 20 of the receptacle 12 by respective hinges (not shown) such that the lids 14 are pivotable between a fully opened position, a partially opened position, and a closed position. The lids 14 may be made from plastic or metal. The lids 14 are mounted side by side and when in the closed position, cover substantially all of the receptacle opening, leaving a narrow slot 23 therebetween. Preferably, the slot width is selected to be narrow enough to prevent a hand from entering inside the receptacle when the lids 14 are closed.

The locking mechanism 16 comprises a pair of pivot arms 24 each having a proximal end pivotably mounted to a mounting plate 25 by a pivot pin. Each mounting plate 25 is welded to each side lip 20 of the receptacle 12 along the same pivot axis. The pivot arms 24 may be moved between a lid unengaged position wherein the distal portion of the pivot arms 24 extend in front of the front side wall (shown in FIG. 1) and a lid engaged position wherein the distal portion of the pivot arms 24 extend over the top of the receptacle (shown in FIG. 2). The locking mechanism 16 also includes a pair of parallel, spaced lock bars, namely an inner lock bar 26 and an outer lock bar 27. These lock bars 26, 27 are elongated members that are attached at their respective ends to the central and distal ends of the pivot arms 24, respectively. The spacing between the two lock bars 26, 27 define a slot sufficient to receive the two lids edgewise.

When the pivot arms 24 are moved into their lid engaged position, and the lids 14 are in their closed position, the inner lock bar 26 extends transversely over and across both lids 14. The inner lock bar 26 can rest on the top surface of the lids 14, or, be placed in sufficient proximity over the lids 14 that the lids 14 cannot be opened enough for a "dumpster diver" to reach inside the receptacle 12. When the pivot arms 24 are moved into their lid engaged position and the lids 14 are partially opened such that their front edges slide through the space between the inner and outer lock bars 26, 27, the two lock bars 26, 27 serve to fix the lids 14 open in their partially opened position. This partially opened position is preferably selected to enable only limited access into the container 10, which is particularly useful to allow cardboard to be deposited into the container 10 for recycling, but to prevent someone from entering into the container to "dumpster dive".

The locking mechanism 16 also includes a lock arm 30 pivotably connected at its proximal end to the inner lock bar 26 such that the lock arm 30 is pivotable about an axis coincidental with the longitudinal axis of the inner lock bar 26. The lock arm 30 has an aperture 32 at its distal end that is dimensioned to receive a shackle of a conventional padlock A, and an aperture 33 at its proximal end that enables the lock arm 30 to receive the inner lock bar 26. The lock arm 30 is preferably laterally located in position on the inner lock bar 26 using a pair of shoulders 28 located on either side of the lock arm 30. The shoulders 28 are laterally secured with tack welds, which allow the shoulders to spin freely on the lock bar 26.

Figure 5:
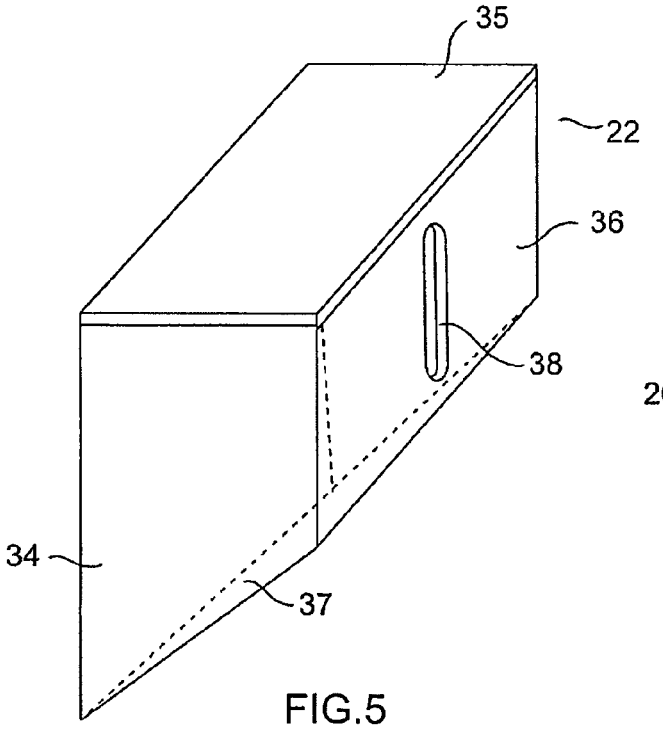
FIG. 5 is a schematic perspective view of a receiving cup of the waste container.

Referring to FIG. 5, the receiving cup 22 is formed by welding together a pair of side plates 34, top plate 35, back plate 36, and bottom plate 37, then welding the cup 22 to a suitably shaped and positioned opening in the front wall 18 such that a recess is provided in the front wall 18. The cup back wall 36 includes a receiving cup aperture 38 dimensioned to receive the distal end of the lock arm 30 therethrough. The top and bottom plates 35, 37 taper downwardly (not shown in FIG. 5) and upwardly respectively towards the back plate 36. The tapered top plate 35 serves to reduce the tendency for refuse to lodge against the receiving cup 22 when loading the receptacle 12, and similarly, the tapered bottom plate 37 serves to reduce the tendency for refuse to lodge against the receiving cup 22 when the receptacle 12 is emptied (and turned upside-down).

Figure 6:
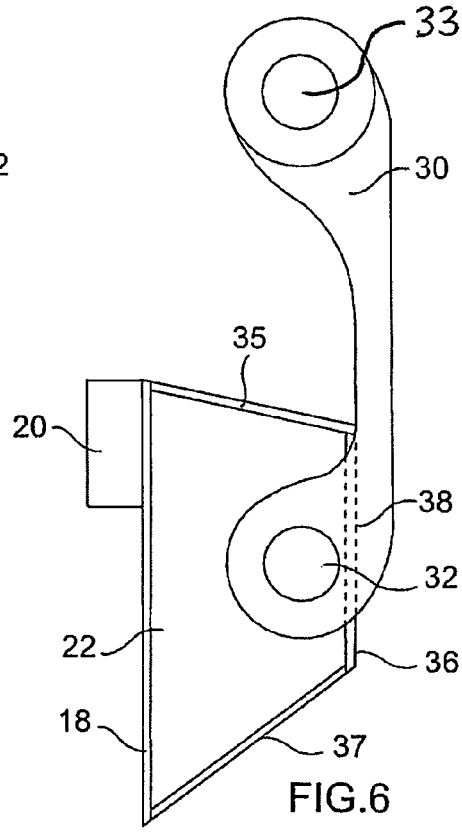
FIG. 6 is a sectioned schematic side view of the locking mechanism engaged with the receiving cup.

Referring to FIG. 6, the distal end of the lock arm 30 is shaped and sized to pass through the receiving cup aperture 38. When the pivot arms 24 are moved into the lid engaged position, the lock arm 30 can be pivoted into a "locking position" wherein its distal end enters into the receptacle 12 through the slot 23 in between the lids 14, through the receiving cup aperture 38, and into the receiving cup 22. Enough of the distal end of the lock arm 30 protrudes through the receiving cup aperture 38 that the lock arm aperture 32 is located entirely in the receiving cup 22. The padlock A (not shown in FIG. 6) can then be fastened to the lock arm 30 by threading its shackle through the lock arm aperture 32. Provided that the body of the padlock A is wider than the aperture 38, the lock arm 30 is secured in this position. When secured in the locking position, the lock bar 26 prevents the lids 14 from being opened enough for a person to readily access the contents of the container 10. Furthermore, when in the locking position, the locking mechanism 16 is tamper-resistant, as most of the lock arm 30 is located inside the receptacle 12 and out of harm's way, and the padlock A is embedded within the receiving cup 22, making it difficult to reach the padlock shackle, e.g. with metal cutters. The width of the receiving cup 22 is selected to be slightly wider than the width of the padlock, thereby making it hard to use a tool to tamper with the padlock. A particularly useful type of padlock for use with the locking mechanism is a circular shield-type padlock, which minimizes the exposure of the shackle.

The locking mechanism can be made with a hardened or tempered steel to provide with increased resistance to tampering. However, it is within the scope of the invention to select alternative materials of similar properties.

Figure 7:
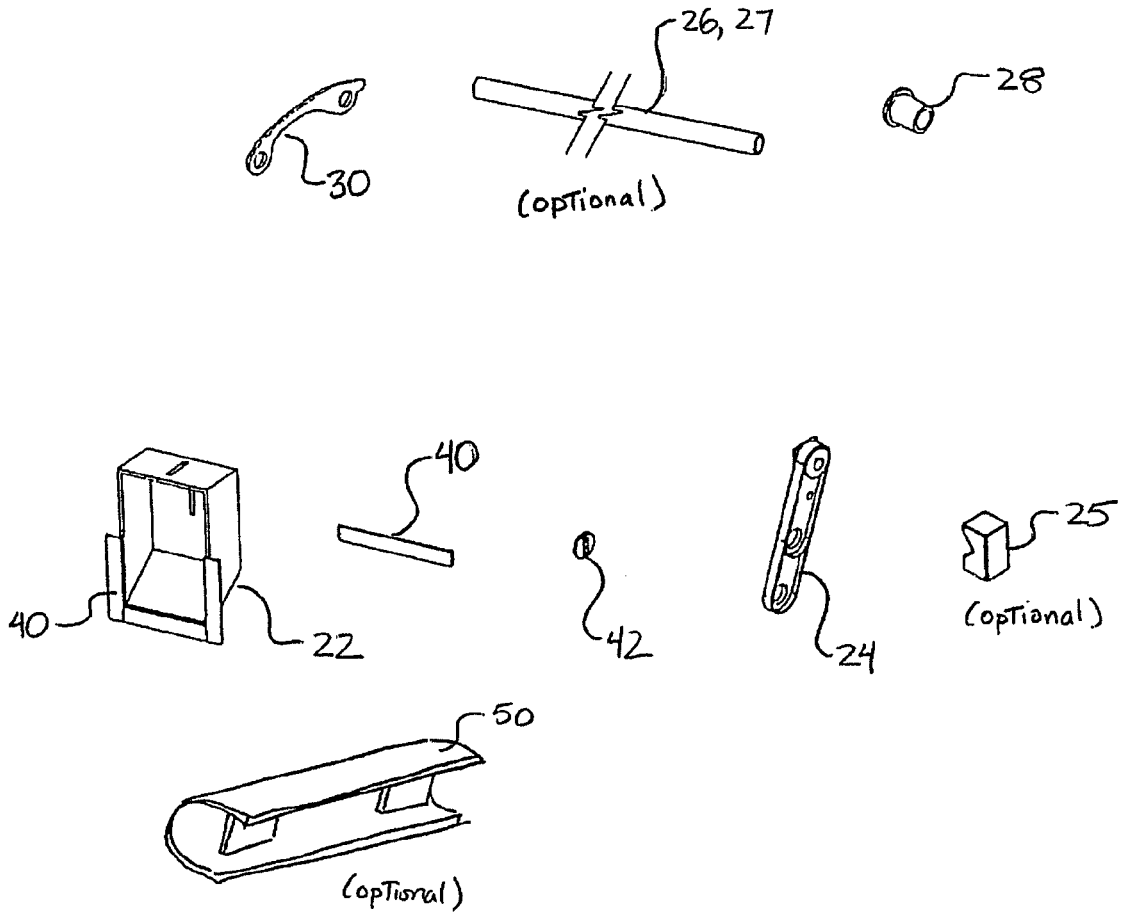
FIG. 7 is a schematic perspective view of a locking mechanism kit according to another embodiment of the invention.

According to another embodiment of the invention, the locking mechanism 16 is provided in kit form and can retrofitted onto existing conventional waste containers, such as front load or roll-off waste containers. Referring now to FIG. 7, the kit comprises the lock bar 30, two shoulders 28, the receiving cup 22, an aperture frame 40, four end caps 42, the pair of pivot arms 24, and the pair of mounting plates 25 (optional). Two additional end caps 42 can be provided to attach each axle end of a lid hinge 43 to prevent somebody from separating the lids 14 from the receptacle 12. The pivot arms 24 are provided with a pivot pin at its proximal end, and with a pair of holes (centrally and distally located) spaced along the arms 24 for receiving and locating the lock arms 26, 27 (optionally provided with kit).

While the locking mechanism 16 as described above is particularly desirable because it minimizes exposure to tampering, other means for locking the lids in the closed or partially opened position can be provided. For example, a pair of hinge lock clips (not shown) can be provided in the kit that are welded to each side of the receptacle at the lip to provide an alternative means for securing the lids in a closed or partially opened positions. The hinge lock clips are provided with a hole that is sized to receive a shackle of a pad-lock. Similar sized holes are provided through each pivot arm 24. When the pivot arms 24 are swiveled over the lid into the lock engaged position, the holes in the pivot arms 24 and in the hinge lock clip align so that a padlock shackle can be threaded therethrough, thereby securing the locking mechanism 16 in place. These hinge lock clips can replace or supplement the lock arm 30 in the kit.

For containers having plastic lids, a lid cap 50 can be included in the kit which covers the hinge mechanism that attaches the lid to the receptacle, and protects the hinge mechanism from tampering. The lid cap 50 is an elongated steel plate bent into a "C" shape that is dimensioned to fit snugly over the ears of the hinge mechanism. The lid cap 50 also has a flat steel plate welded to the inside of the bent steel plate and which serves as the connector with the hinge.

Figure 8:
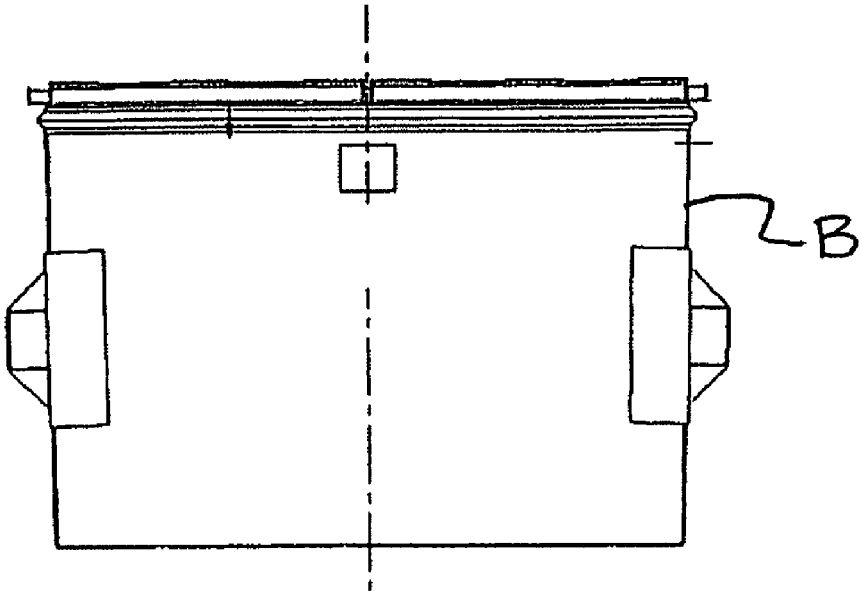
FIG. 8 is a schematic front elevation view of one step in installing the kit onto a waste container, namely cutting an aperture in a front sidewall of the container.
Figure 9:
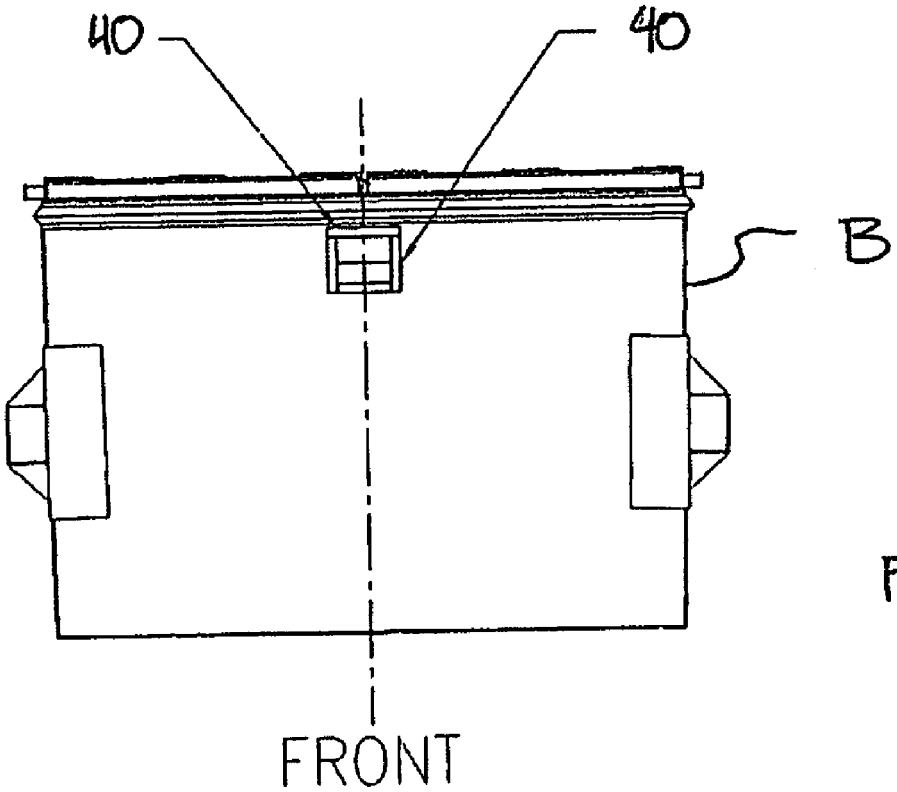
FIG. 9 is a schematic front elevation view of another step in installing the kit onto a waste container, namely attaching a receiving cup behind the front sidewall of the container.
Figure 10:
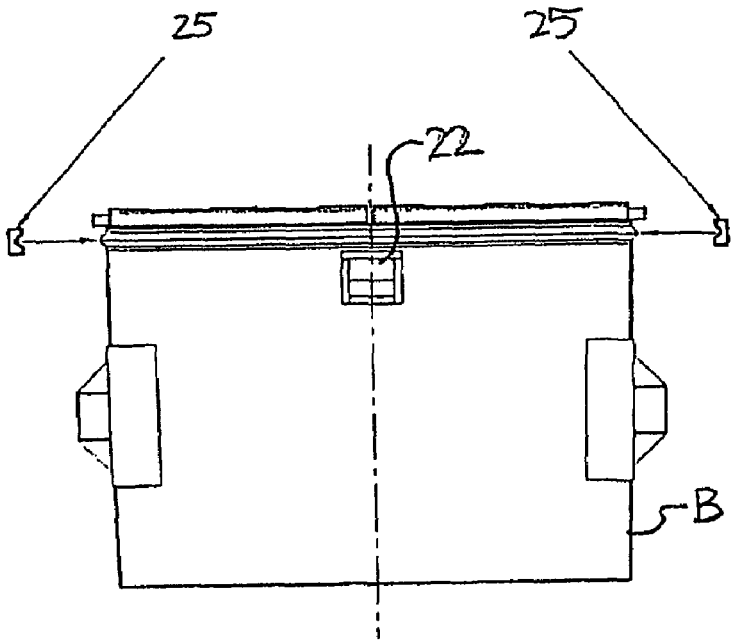
FIG. 10 is a schematic front elevation view of yet another step in installing the kit onto a waste container, namely mounting a pair of mounting plates onto the container.
Figure 11:
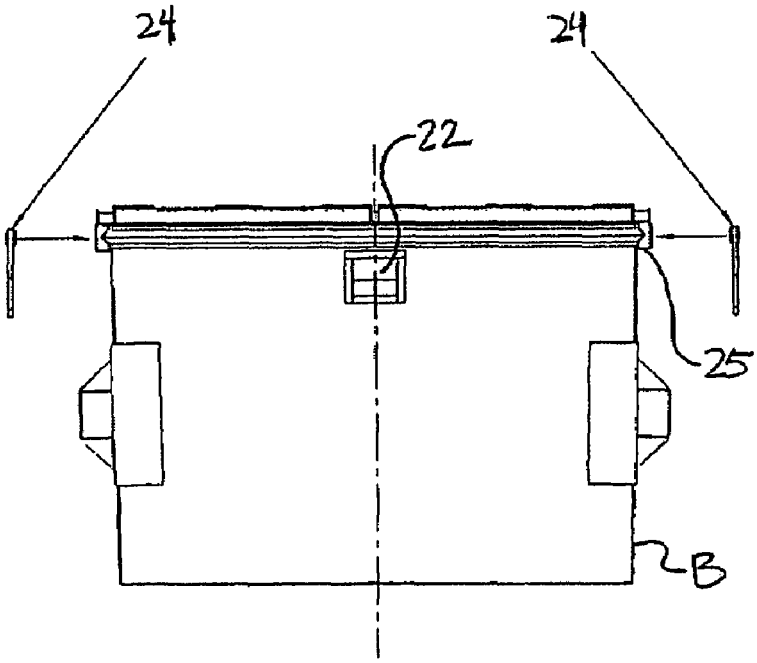
FIG. 11 is a schematic front elevation view of another step in installing the kit onto a waste container, namely mounting a pair of pivot arms onto the mounting plates.
Figure 12B:
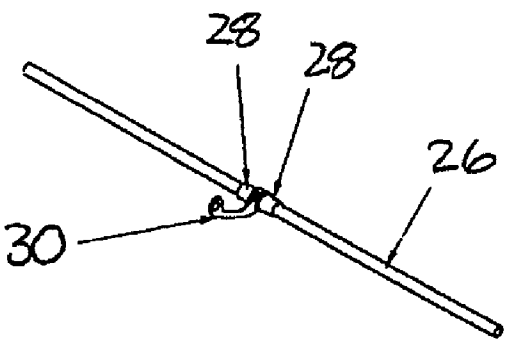
FIGS. 12(*a*) and (*b*) are schematic front and perspective views of yet another step in installing the kit onto a waste container, namely, mounting a lock arm and a pair of shoulders onto an inner lock bar.
Figure 12A:
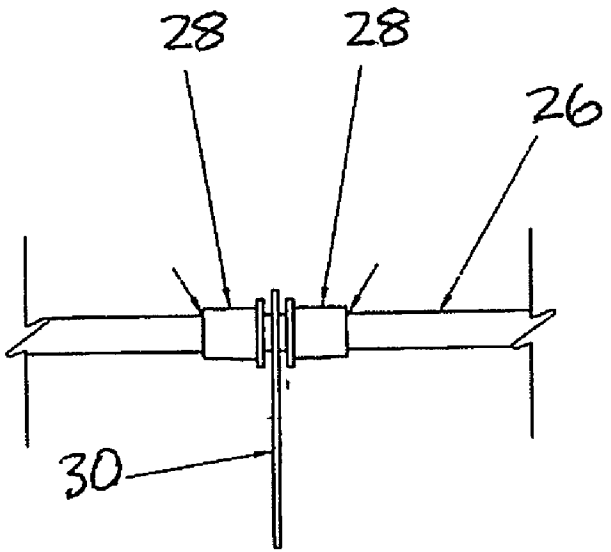
Figure 13:
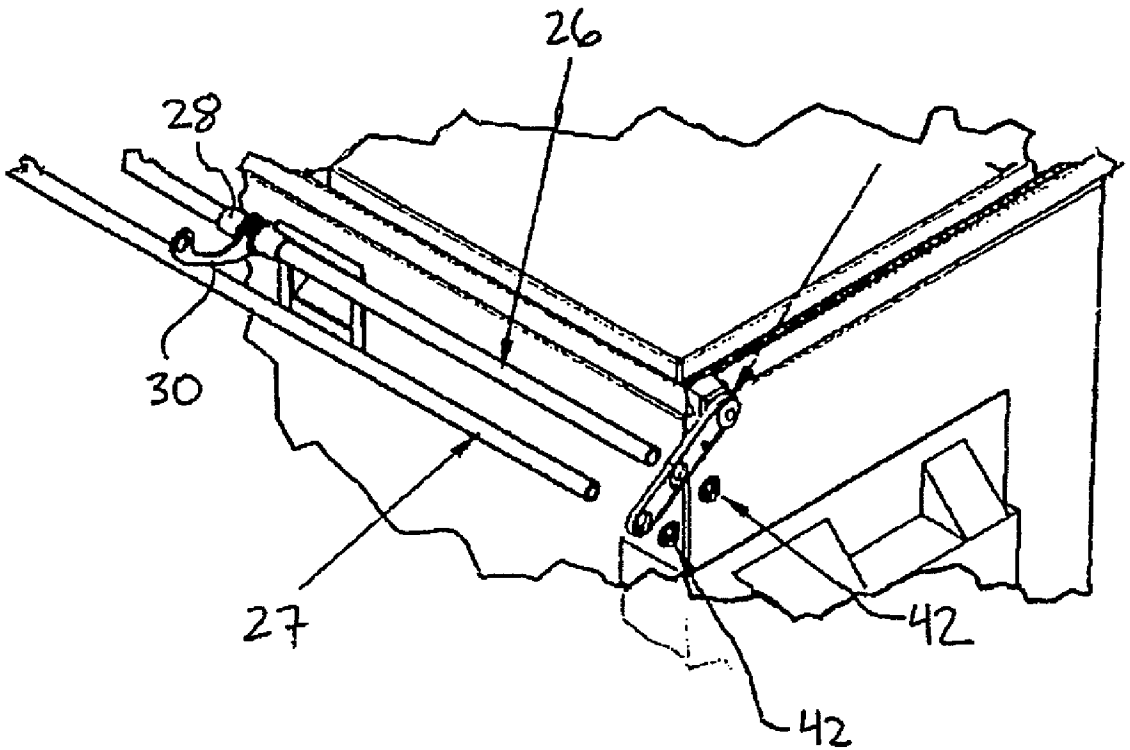
FIG. 13 is a schematic perspective view of yet another step in installing the kit onto a waste container, namely, attaching the inner lock bar and an outer lock bar to the pivot arms.

To install the locking mechanism 16 onto a conventional front load waste container B, the following steps are carried out:

- cut a rectangular aperture through the front wall of the container B of dimensions corresponding to the receiving cup aperture, and at a location that enables the receiving cup 22 to be mounted to the side wall such that the top of the receiving cup 22 is flush with the top of the container sidewall (FIG. 8);
- weld receiving cup 22 to the back surface of the front sidewall such that the receiving cup opening is aligned with the front wall aperture (FIG. 9);

weld aperture frame 40 along the top edge of the front wall aperture (FIG. 9);

weld each mounting plate 25 to respective left and right side lips of the container B at the intersection with the front lip (this step is optional: if the container B does not have a side lip, and has suitably located vertical surfaces that are appropriate for mounting the pivot arms, then the mounting plates 25 do not have to be used) (FIG. 10);

mount the proximal (pivot pin end) pivot arms 24 to respective left and right mounting plate such that the pivot arms 24 pivot about the mounting plates 25 (FIG. 11);

if not already provided in the kit, obtain a pair of pipe of suitable diameter or other suitable elongated members to serve as lock bars 26, 27 and cut to a length that enables the lock bars 26, 27 to be mounted at each end to the pivot arms 24 (FIGS. 12(*a*) and (*b*));

slide the lock arm 30 and shoulders 28 over one lock bar 26 and locate in the center of the lock bar 26; apply tack welds onto the bar 28 on the outside of the two shoulders 28 (FIGS. 12(*a*) and (*b*));

insert the lock bar 26 and lock arm 30 sub-assembly through the centrally-located holes of the pivot arms 24 and weld a pair of end caps thereto, thereby securing the lock bar 26 in place (FIG. 13); then, insert the other lock bar 27 through the distally-located holes of the pivot arms 24 and weld a pair of end caps thereto, thereby securing the lock bar 27 in place (FIG. 13).

While the preferred embodiment of the invention has been illustrated and described, it will be appreciated that various changes can be made therein without departing from the scope and spirit of the invention. For example, a single pivot arm may be provided in place of the pair shown in the Figures. Also, the container may be provided with a single lid instead of the pair shown in the Figures; in such case, the lid is provided with an aperture dimensioned to receive the lock arm therethrough.

What is claimed is:

1. A lockable container comprising:

(a) a receptacle comprising a base, a top with a main receptacle opening, and a side wall extending around and between the base and top;

(b) a lid movably mounted to the receptacle and configured to cover at least a portion of the receptacle opening when in a closed position;

(c) a locking mechanism comprising a receptacle engagement portion movably attached to the receptacle and movable into a lid engagement position;

a first lid engagement portion attached to the receptacle engagement portion such that the lid engagement portion extends sufficiently over the lid to impede the lid from opening when the lid is in the closed position and the receptacle engagement portion is in the lid engagement position;

a second lid engagement portion attached to the receptacle engagement portion such that the lid is securable in a partially opened position when the receptacle engagement portion is in the lid engagement position; and the locking mechanism being lockable by a padlock such that the receptacle engagement portion is fixed in the lid engagement position.

2. A lockable container as claimed in claim 1 wherein the second lid engagement portion is a slot configured to engage the lid edgewise.

3. A lockable container as claimed in claim 1 wherein the receptacle further comprises a locking mechanism aperture in the side wall, the closed lid covers a portion of the receptacle opening, and the locking mechanism further comprises a lock engagement portion attached to the first or second lid engagement portion and is extendable through the receptacle opening into the receptacle, and through the locking mechanism aperture out of the receptacle, and is securable in place with a padlock when the receptacle engagement portion is in the lid engagement position.

4. A lockable container as claimed in claim 1 wherein the receptacle engagement portion is a pivot arm having a proximal end pivotably attached to the receptacle side wall and a distal end extending above the lid when the pivot arm is pivoted into the lid engagement position.

5. A lockable container as claimed in claim 4 wherein the first lid engagement portion is a first elongated member attached to the pivot arm such that the member extends sufficiently over a closed lid to impede the lid from opening when the pivot arm is in the lid engagement position.

6. A lockable container as claimed in claim 5 wherein the second lid engagement portion is a second elongated member attached to the pivot arm substantially parallel to and spaced from the first elongated member such that a slot is defined therebetween suitable to receive the lid edgewise.

7. A lockable container as claimed in claim 6 wherein the receptacle side wall comprises a locking mechanism aperture, the lid covers a portion of the receptacle opening when in the closed position, and the locking mechanism further comprises a lock arm having a proximal end pivotably attached to the first or second elongated member and a distal end having an aperture for receiving the padlock, and when the pivot arm is in the lid engagement position, the lock arm is pivotable into a lid securing position with the distal end extending through the receptacle opening into the receptacle, then through the locking mechanism aperture out of the receptacle, and securable in place with the padlock.

8. A lockable container as claimed in claim 7 comprising a pair of lids mountable side-by-side over the receptacle opening such that sufficient space is provided therebetween to enable the lock arm to pivot into the receptacle, the lids being mounted on the receptacle such that the first and second elongated members extend over both lids.

9. A lockable container as claimed in claim 8 wherein the receptacle engagement portion comprises a pair of pivot arms both pivotably attached at their proximal ends to the side wall about the same pivot axis, the pivot arms being attached to the respective ends of the first and second elongated members.

10. A lockable container as claimed in claim 8 wherein the side wall includes a recess for receiving the padlock, and the locking mechanism aperture is located in a back wall of the recess.

11. A lockable container as claimed in claim 10 wherein the recess dimensions are selected to snugly receive the padlock in the recess thereby impeding access of padlock tampering devices to the padlock.

12. A locking mechanism for a container having a receptacle with a base, a top with a main receptacle opening, and a side wall extending around and between the base and top, and a lid movably mounted to the receptacle and configured to cover at least a portion of the main receptacle opening, the locking mechanism comprising:

(a) a receptacle engagement portion movably attachable to the receptacle and movable into a lid engagement position;

(b) a first lid engagement portion attachable to the receptacle engagement portion such that the lid engagement portion extends sufficiently over the lid to impede the lid from opening when the lid is in the closed position and the receptacle engagement portion is in the lid engagement position; and (c) a second lid engagement portion attachable to the receptacle engagement portion such that the lid is securable in a partially opened position when the receptacle engagement portion is in the lid engagement position;

the locking mechanism being lockable by a padlock such that the receptacle engagement portion is fixed in the lid engagement position.

13. A locking mechanism as claimed in claim 12 wherein the second lid engagement portion is a slot configured to engage the lid edgewise.

14. A locking mechanism as claimed in claim 12 wherein the closed lid covers a portion of the receptacle opening, and the locking mechanism further comprises:

a receiving cup having a locking mechanism aperture and mountable over an aperture in the receptacle side wall, and a lock engagement portion attachable to the first or second lid engagement portion and extendable through the receptacle opening into the receptacle, and through the locking mechanism aperture out of the receptacle, and is securable in place with a padlock when the receptacle engagement portion is in the lid engagement position.

15. A locking mechanism as claimed in claim 12 wherein the receptacle engagement portion is a pivot arm having a proximal end pivotably attachable to the receptacle side wall and a distal end extending above the lid when the pivot arm is pivoted into the lid engagement position.

16. A locking mechanism as claimed in claim 15 wherein the first lid engagement portion is a first elongated member attachable to the pivot arm such that the member extends sufficiently over a closed lid to impede the lid from opening when the pivot arm is in the lid engagement position.

17. A locking mechanism as claimed in claim 16 wherein the second lid engagement portion is a second elongated member attachable to the pivot arm substantially parallel to and spaced from the first elongated member such that the slot is defined therebetween suitable to receive the lid edgewise.

18. A locking mechanism as claimed in claim 17 wherein the lid covers a portion of the receptacle opening and the locking mechanism further comprises a receiving cup having a locking mechanism aperture and mountable over an aperture in the receptacle side wall, and a lock arm having a proximal end pivotably attachable to the first or second elongated member and a distal end with an aperture for receiving the padlock, and when the pivot arm is in the lid engagement position, the lock arm is pivotable into a lid securing position with the distal end extending through the receptacle opening into the receptacle, then through the locking mechanism aperture out of the receptacle, and is securable in place with the padlock.

19. A locking mechanism as claimed in claim 17 wherein the lid engagement portion comprises a pair of pivot arms both pivotably attachable at their proximal ends to the side wall about the same pivot axis, the pivot arms being attached to the respective ends of the first and second elongated members.

* * * * *